US011142376B2

(12) United States Patent
Choltco-Devlin

(10) Patent No.: US 11,142,376 B2
(45) **Date of Patent: *Oct. 12, 2021**

(54) CAM LID FOR DRINKING VESSEL

(71) Applicant: Pacific Market International, LLC, Seattle, WA (US)

(72) Inventor: Evan Michael Choltco-Devlin, Ellensburg, WA (US)

(73) Assignee: Pacific Market International, Inc., Seattle, WA (US)

( * ) Notice: Subject to any disclaimer, the term of this patent is extended or adjusted under 35 U.S.C. 154(b) by 96 days.

This patent is subject to a terminal disclaimer.

(21) Appl. No.: 16/694,955

(22) Filed: Nov. 25, 2019

(65) Prior Publication Data

US 2020/0102127 A1 Apr. 2, 2020

Related U.S. Application Data

(63) Continuation of application No. 15/867,526, filed on Jan. 10, 2018, now Pat. No. 10,486,866, which is a continuation of application No. 14/964,421, filed on Dec. 9, 2015, now Pat. No. 9,938,054.

(60) Provisional application No. 62/133,234, filed on Mar. 13, 2015.

(51) Int. Cl.

| | |
|---|---|
| ***B65D 43/26*** | (2006.01) |
| ***B65D 43/02*** | (2006.01) |
| ***B65D 43/16*** | (2006.01) |
| ***B65D 51/18*** | (2006.01) |
| ***B65D 47/08*** | (2006.01) |

(52) U.S. Cl.

CPC ..... *B65D 43/265* (2013.01); *B65D 43/02* (2013.01); *B65D 43/16* (2013.01); *B65D 47/0895* (2013.01); *B65D 51/18* (2013.01); *B65D 2251/009* (2013.01); *B65D 2251/0021* (2013.01); *B65D 2251/0028* (2013.01); *B65D 2251/0081* (2013.01); *B65D 2543/00046* (2013.01)

(58) Field of Classification Search

CPC .... B65D 39/08; B65D 51/243; B65D 43/265; B65D 47/0895; B65D 17/506

See application file for complete search history.

(56) References Cited

U.S. PATENT DOCUMENTS

| | | | |
|---|---|---|---|
| 6,626,314 | B1 | 9/2003 | McHenry et al. |
| D651,847 | S | 1/2012 | Gilbert |
| 2012/0031902 | A1 | 2/2012 | Gilbert |

*Primary Examiner* — Jeffrey R Allen

(74) *Attorney, Agent, or Firm* — George C. Rondeau, Jr.; Davis Wright Tremaine. LLP

(57) ABSTRACT

A lid assembly including a camming lever and a sealing member for selectively sealing and unsealing a drinking aperture of a lid main body. The camming lever is rotatably to selectively move the sealing member between a sealed position adjacent to and an unsealed position spaced apart from the drinking aperture. The camming lever includes a lever arm extending from two cams having a cam axle extending therebetween. The cam axle is pivotally attached to the sealing member, which is pivotally attached to the lid main body. The cams engage an upper surface of the lid main body. A stub axle extends laterally outward from each cam and engages a ledge which limiting upward movement of the cams.

30 Claims, 16 Drawing Sheets

CAM LID FOR DRINKING VESSEL

CROSS REFERENCE

The current application is a continuation of U.S. patent application Ser. No. 15/867,526, filed Jan. 10, 2018, which is a continuation of U.S. patent application Ser. No. 14/964,421, filed Dec. 9, 2015, now U.S. Pat. No. 9,938,054, which claims priority to U.S. Provisional Patent Application No. 62/133,234 filed Mar. 13, 2015, which is hereby incorporated by reference in its entirety.

FIELD OF INVENTION

The present invention relates to removable lids for drinking vessels and more precisely lids having camming mechanisms for sealing and unsealing a drinking aperture using a sealing element.

BACKGROUND

U.S. Patent Application Publication No. 2012/0031902 and U.S. Design Pat. No. D651,847 disclose a drinking container lid with a handle that rotates to selectively open and close a cover of the lid.

DETAILED DESCRIPTION

Figure 1A:
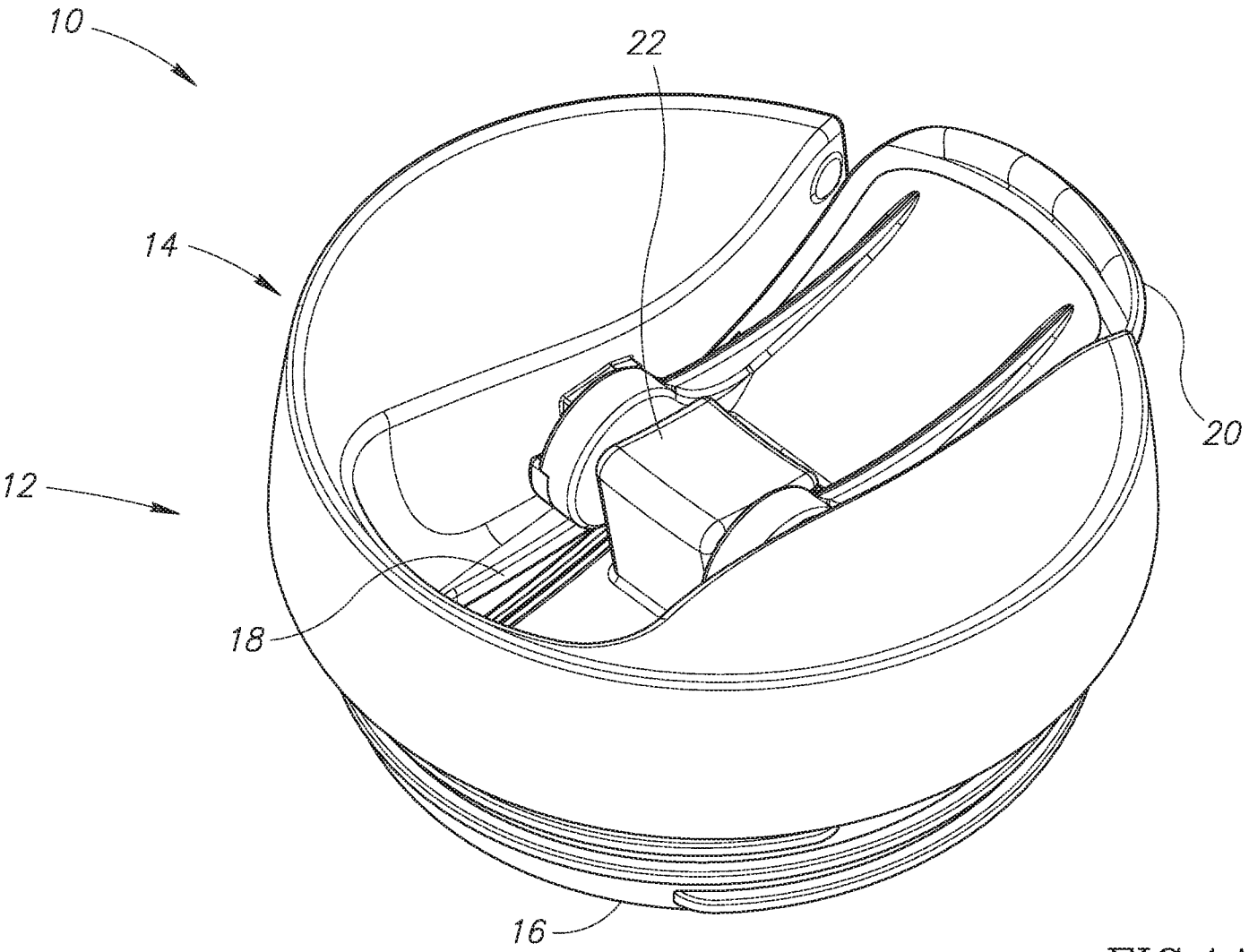
FIG. 1A illustrates a top perspective view of a lid assembly for a drinking vessel in an unsealed configuration.
Figure 1B:
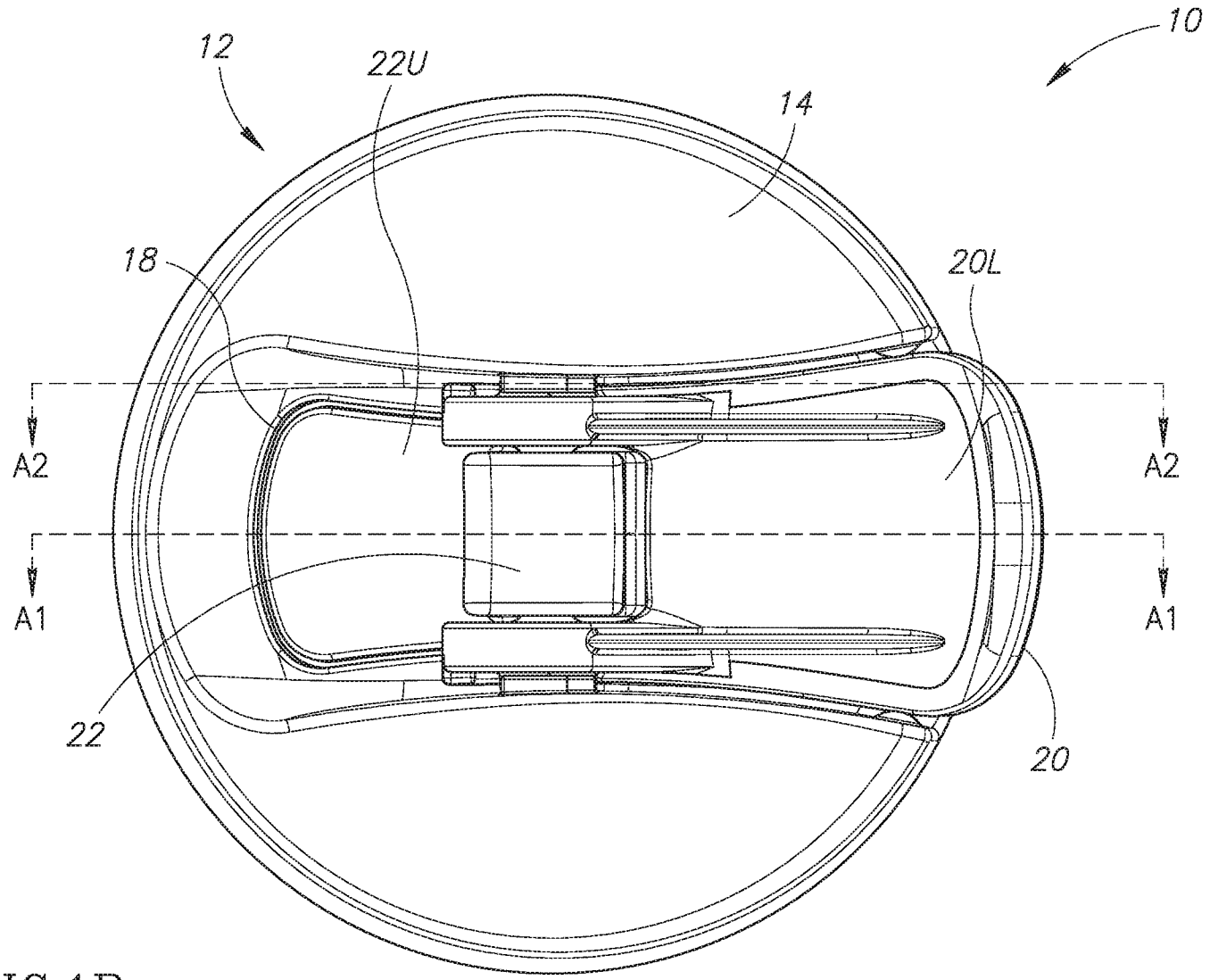
FIG. 1B illustrates a top plan view of the lid assembly of FIG. 1A in the unsealed configuration.
Figure 1C:
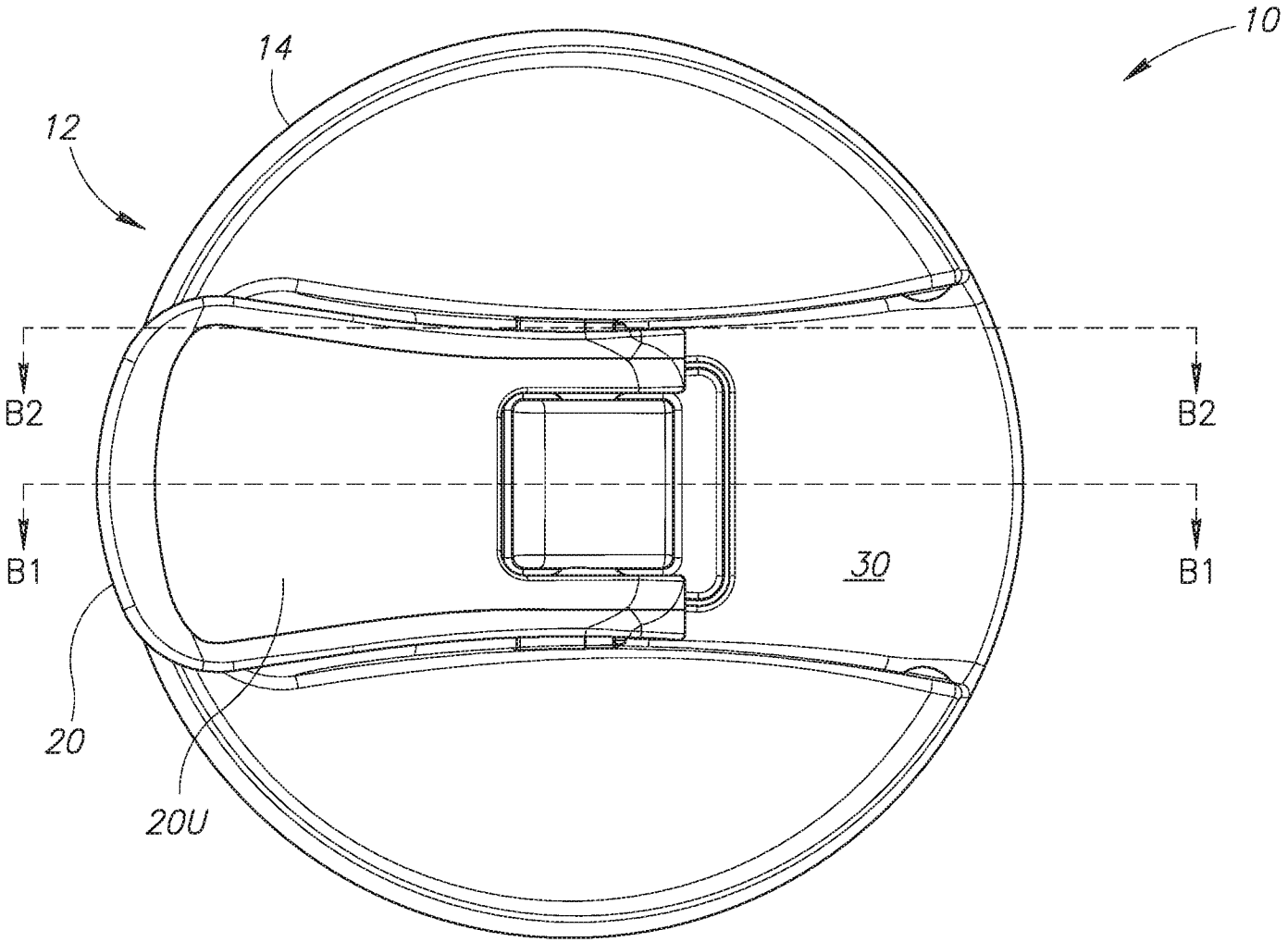
FIG. 1C illustrates a top plan view of the lid assembly of FIG. 1A in a sealed configuration.
Figure 6A:
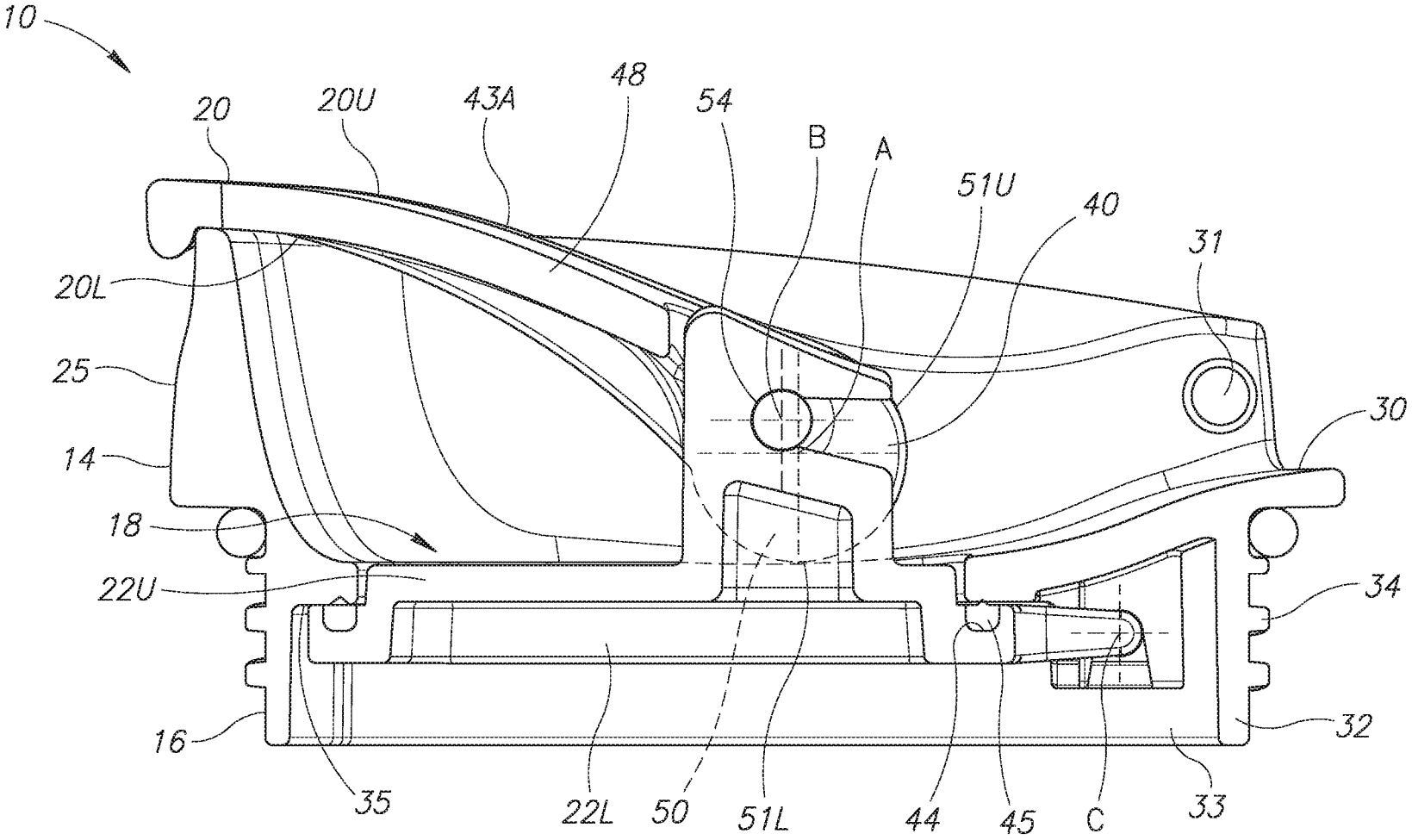
FIG. 6A illustrates a first cross-sectional side view taken substantially along the line B1-B1 of FIG. 1C of the lid assembly of FIG. 1A in the sealed configuration.
Figure 6B:
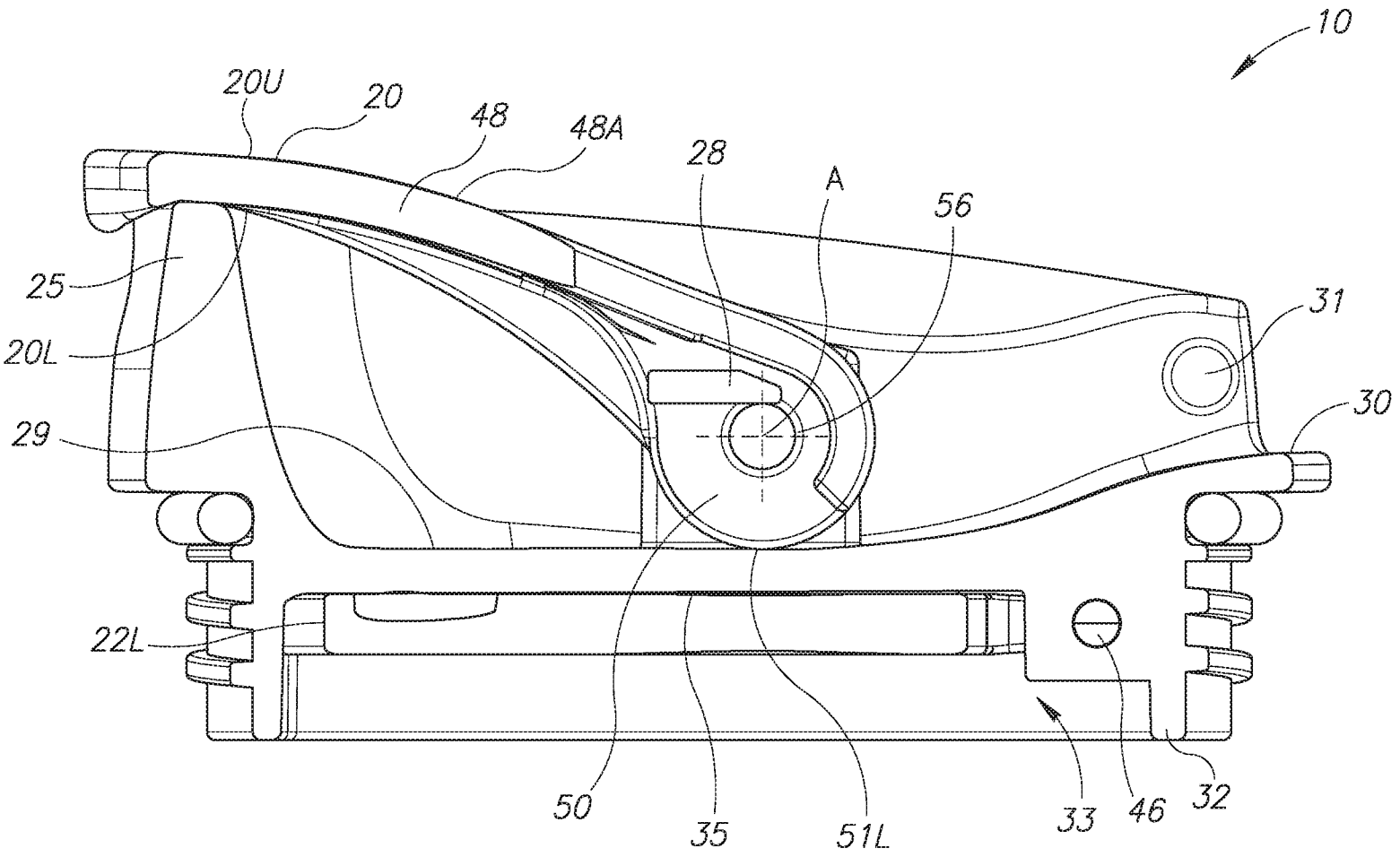
FIG. 6B illustrates a second cross-sectional side view taken substantially along the line B2-B2 of FIG. 1C of the lid assembly of FIG. 1A in the sealed configuration.

A lid assembly 10 in accordance with the present embodiment is shown in FIG. 1A. The lid assembly 10 has a substantially cylindrical lid main body 12 having an upper portion 14 and a lower portion 16. The lid main body 12 includes an elongated drinking aperture 18 through which liquid may flow. A camming lever 20 is operable to selectively seal and unseal a sealing member 22 to close and open, respectively, the drinking aperture 18. When the camming lever 20 is moved to a first position where a lower surface 20L of the camming lever is proximate a forward upper surface portion of the upper portion 14, the sealing member 22 is in a sealed position pressed against the drinking aperture 18, as shown in FIGS. 1C, 6A and 6B. When the camming lever 20 is moved to a second position where an upper surface 20U of the camming lever is proximate a rearward portion of the upper portion 14, as shown in FIGS. 1A, 1B, 7A, and 7B, the sealing member 22 is in an unsealed position spaced apart from and below the drinking aperture 18.

Figure 2A:
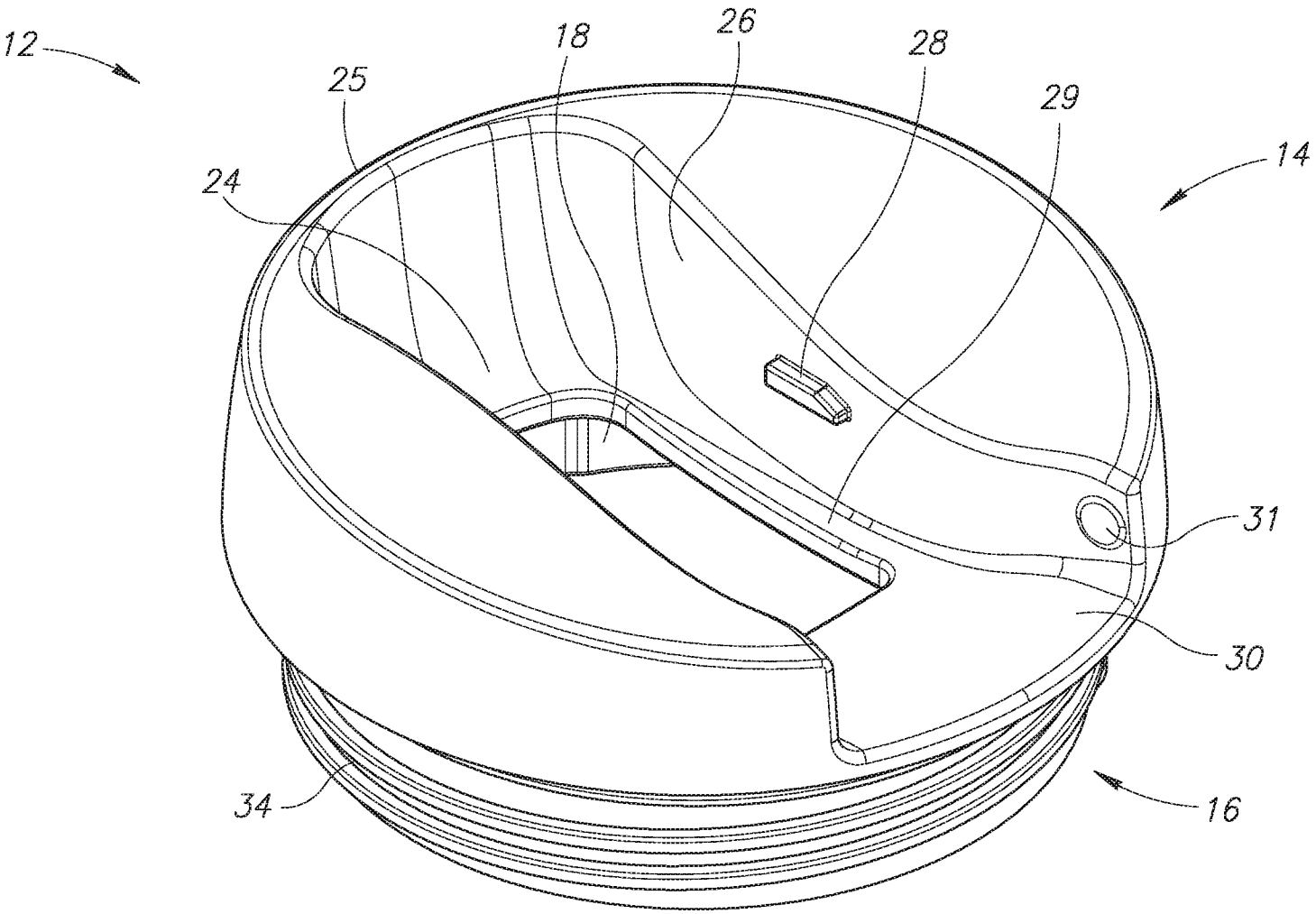
FIG. 2A illustrates a top perspective view of a lid main body of the lid assembly of FIG. 1A.
Figure 2B:
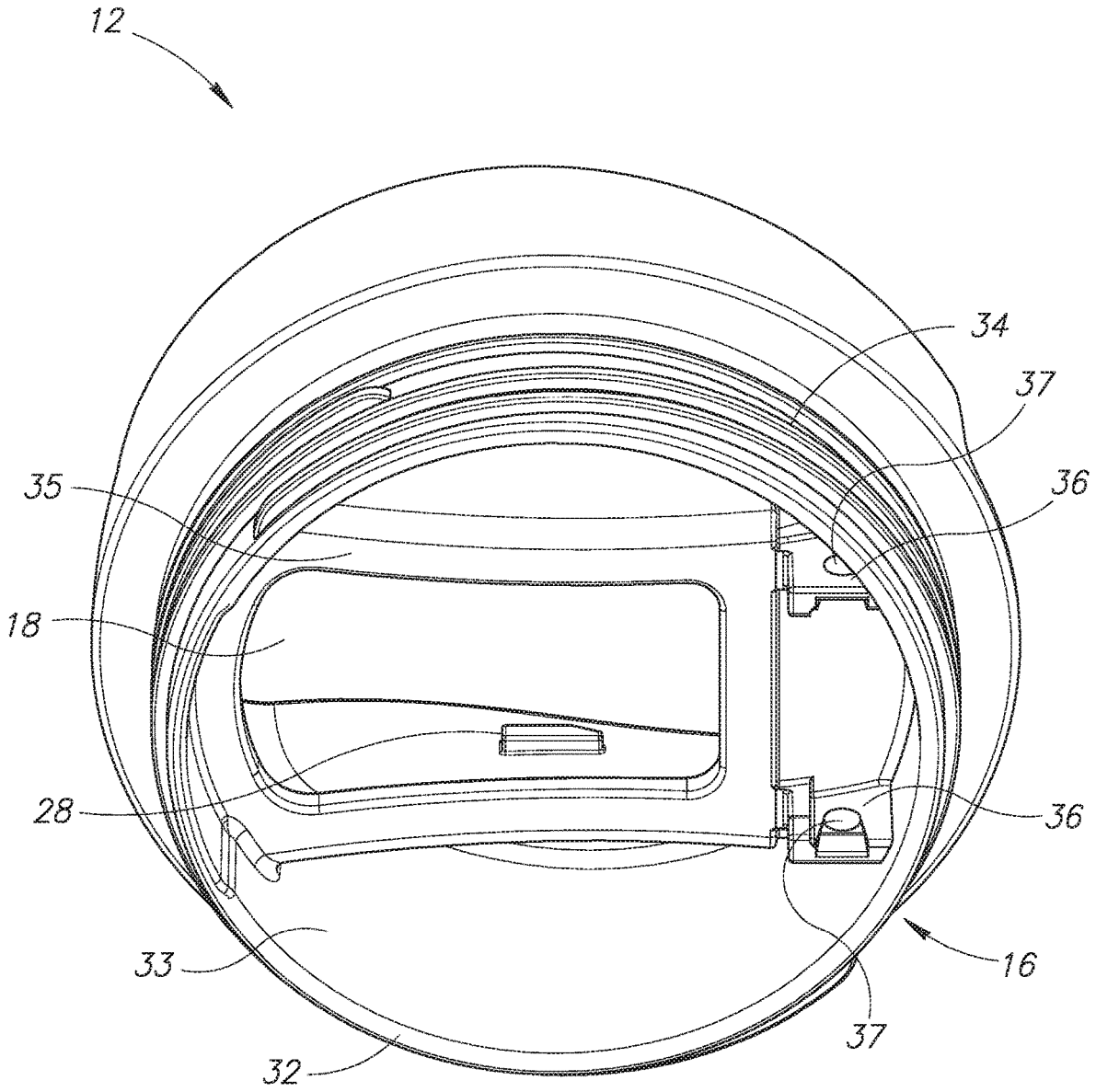
FIG. 2B illustrates a bottom perspective view of the lid main body of FIG. 2A.
Figure 2C:
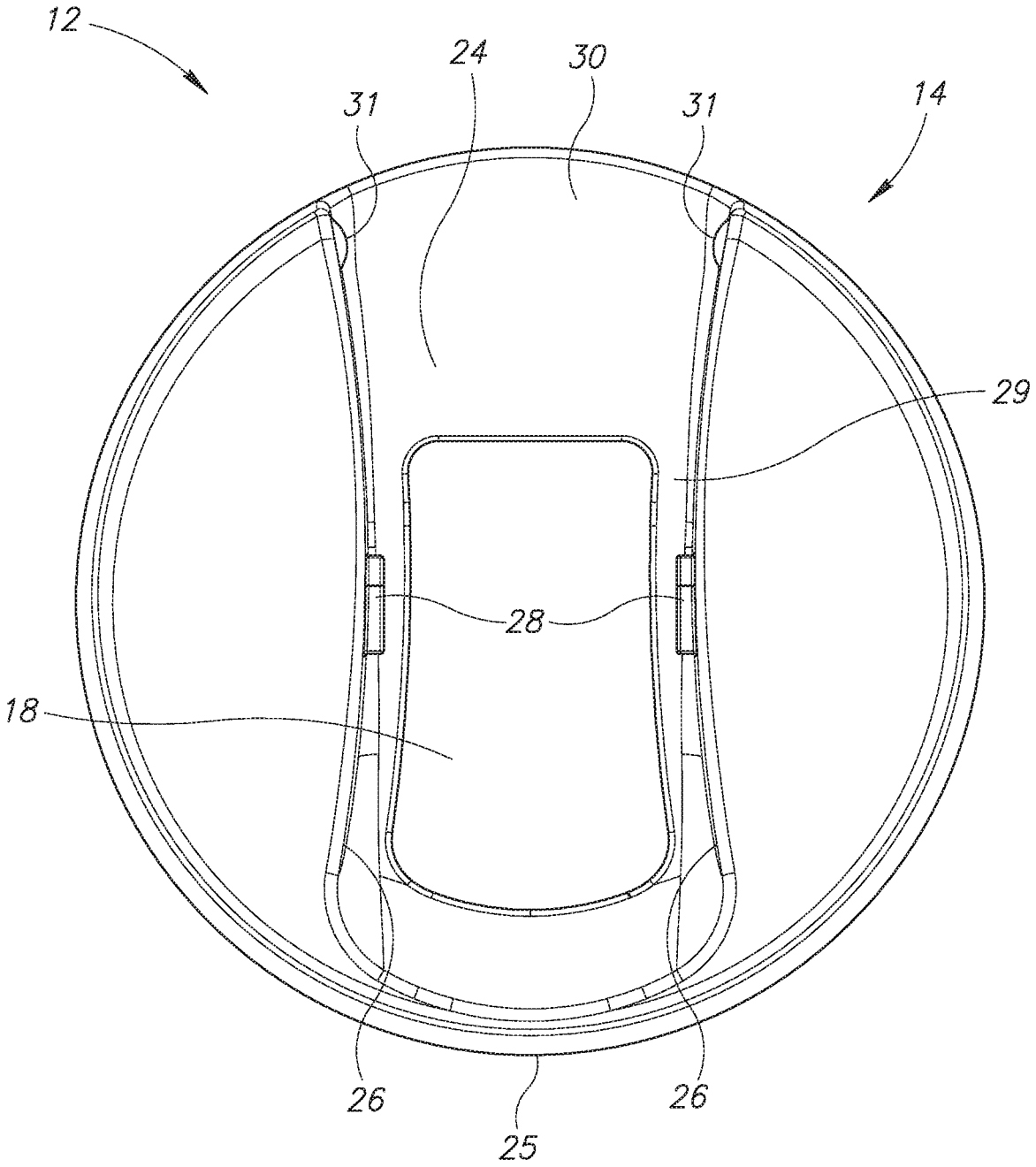
FIG. 2C illustrates a top plan view of the lid main body of FIG. 2A.

The lid main body 12 may be provided with an elongated recess 24 that extends between a forward end and a rearward end along the upper portion 14, as shown in FIGS. 2A and 2C. The elongated recess 24 terminates at a drinking lip 25 at the forward end, which projects upwardly from a forward end of the drinking aperture 18. The elongated recess 24 includes left and right sidewalls 26 projecting upwardly above the drinking aperture 18 on opposite sides of the drinking aperture 18. A stop or ledge 28 projects laterally inward from each of the left and right opposing sidewalls 26 near a center portion of the elongated recess 24. The ledges 28 may have a length and profile extending along the center portion of the elongated recess. In an alternative embodiment the ledges 28 may be the upper elongated walls of slots formed in the sidewalls 26. The lid main body 12 has a lid upper surface 29 extending around the drinking aperture 18 on an upper portion side of the lid main body 12. The lid upper surface 29 may incline upward to an elevated portion 30 at the rearward end of the elongated recess 24 opposite to the drinking lip 25, as shown in FIGS. 6A, 6B, 7A, and 7B. The lid main body 12 may have detents 31 that protrude inwardly from opposing sidewalls 26 near the rearward end of the elongated recess 24 opposite to the drinking lip 25.

Figure 8:
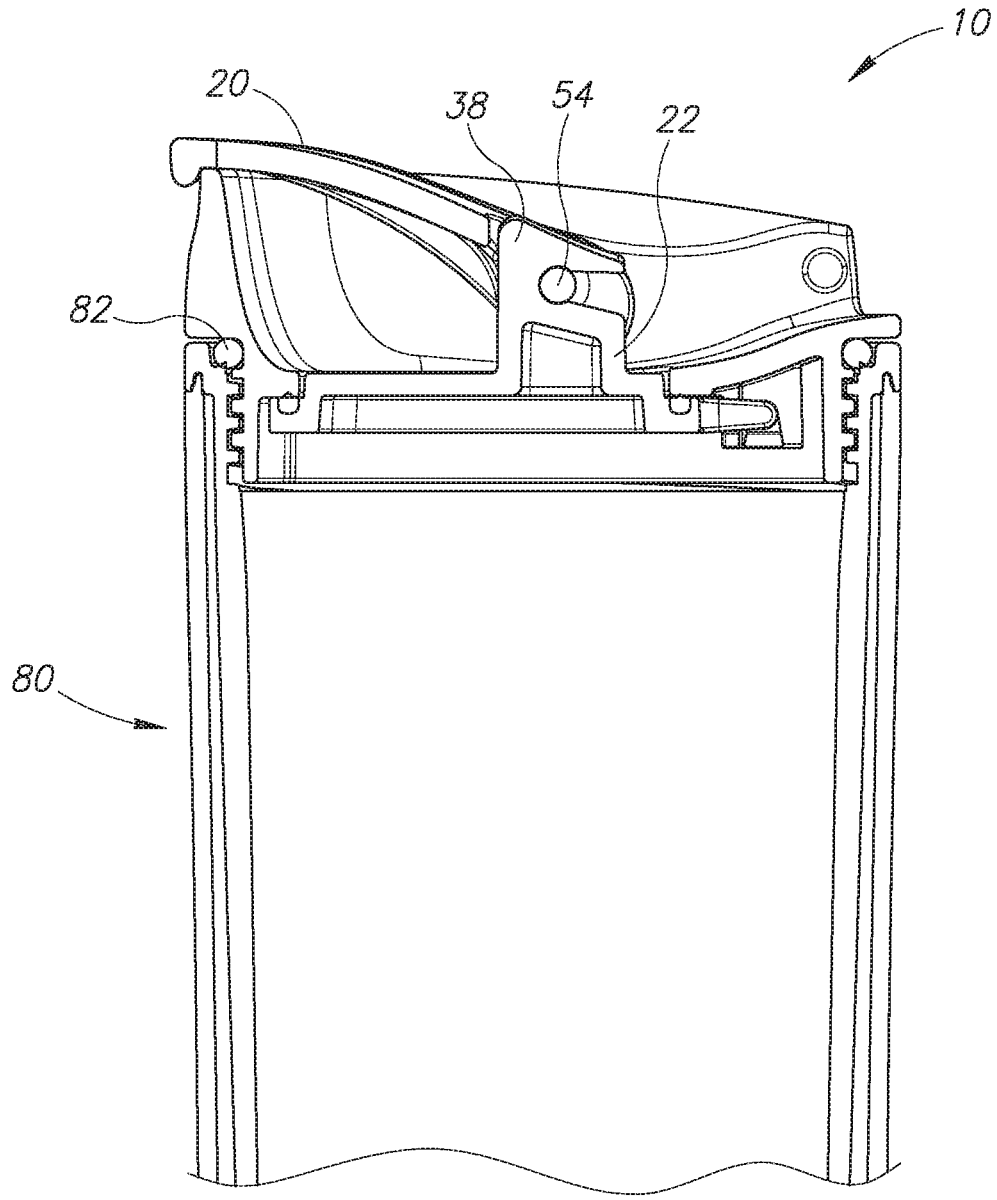
FIG. 8 illustrates a cross-sectional view of the lid assembly of FIG. 1A attached to a drinking vessel.

The lower portion 16 of the lid main body 12 may include a downwardly projecting circumferentially extending sidewall 32 to form a downwardly opening open-ended cavity 33, as shown in FIGS. 2B, 6A, and 6B. A lid lower surface 35 extends around the perimeter of the drinking aperture 18 on a lower portion side of the lid main body 12. The sidewall 32 may be provided with a vessel attachment portion 34, such as a thread portion that may threadably attached to a corresponding threaded portion of a drinking vessel 80, as shown in FIG. 8. The vessel attachment portion 34 may use other attachment features to removably join the lid assembly 10 to the drinking vessel 80 in a fluid-tight configuration, such as a bayonet mount or friction fit, and may include an O-ring 82 or gasket sized to aid in sealing the lid assembly 10 to the drinking vessel 80.

Figure 3A:
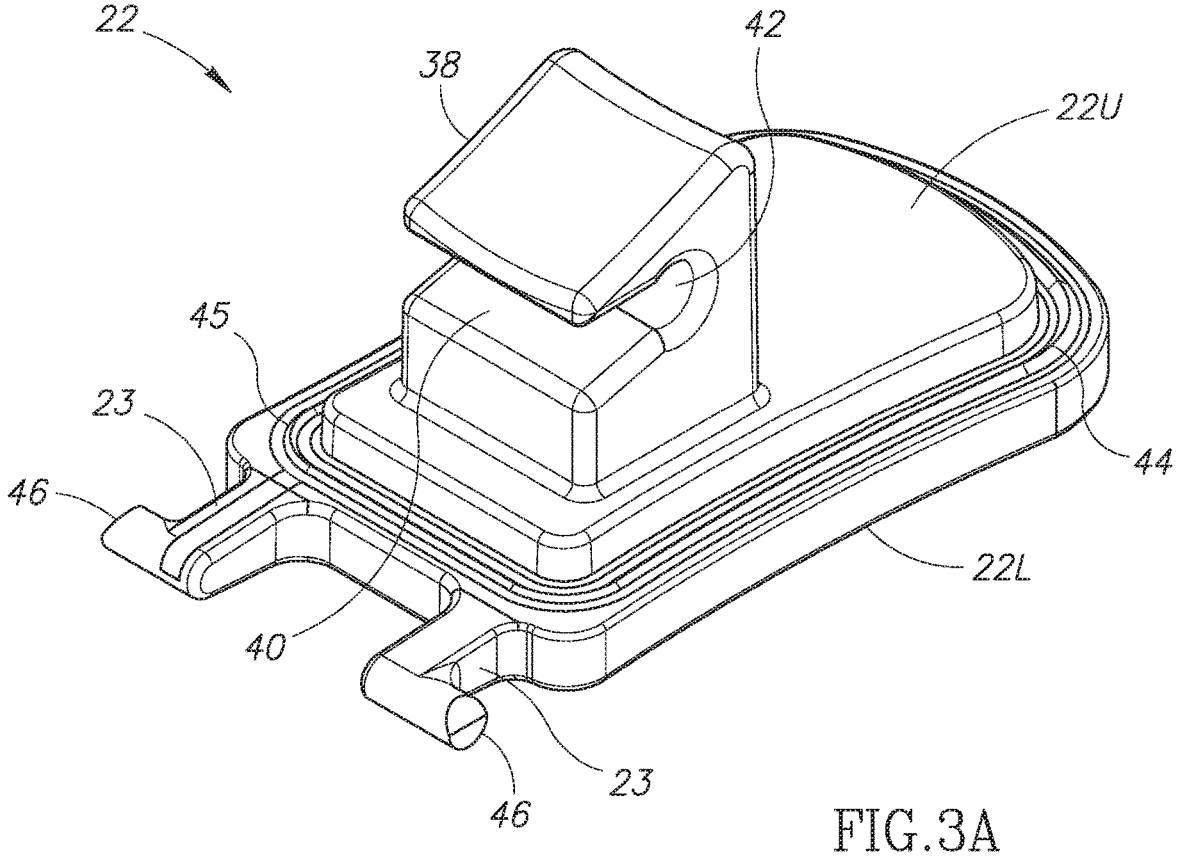
FIG. 3A illustrates a top perspective view of a sealing member of the lid assembly of FIG. 1A.
Figure 3B:
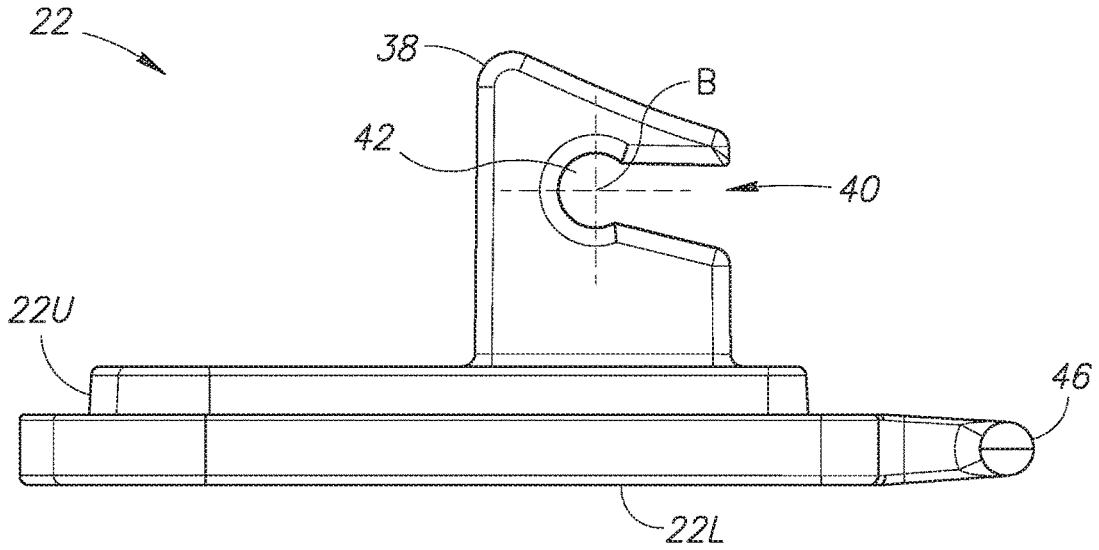
FIG. 3B illustrates a side view of the sealing member of FIG. 3A.

Referring to FIGS. 3A and 3B, the sealing member 22 has a sealing member upper portion 22U that is sized and shaped to snuggly fit within the drinking aperture 18. A lower portion 22L of the sealing member 22 has a larger size than the upper portion 22U to cover and seal the drinking aperture 18 from below by sealing engagement with the lid lower surface 35 of the lower portion 16 which extends around the perimeter of the drinking aperture. The lower portion 16 is provided with spaced-apart, downwardly projecting, sealing member attachment portions 36, as shown in FIG. 2B, to which the sealing member 22 is pivotally attached for rotational movement of the sealing member between sealed and unsealed positions with respect to the drinking aperture 18. In the present embodiment, the sealing member attachment portions 36 each include an aperture 37 which rotatably receive therein one of two laterally outward extending pivot pins 46 of the sealing member 22. Each of the pivot pins 46 is attached to a rearward end of an arm 23 which projects rearwardly from the lower portion 22L of the sealing member 22. The sealing member attachment portions 36 and he sealing member 22 may instead be constructed in other manners to provide rotational attachment of the sealing member 22 to the lid main body 12.

An axle attachment element 38 (connector member) of the sealing member 22 projects upwardly from the sealing member upper portion 22U. An axle insertion opening 40 is provided on the axle attachment element 38 for receiving a cam axle 54 of the camming lever 20 therethough for assembly of the camming lever and the sealing member. The axle insertion opening 40 has a tapered mouth portion to facilitate easy insertion of the cam axle 54 during assembly with the sealing member 22 (see FIGS. 3A, 3B, 6A and 7A). The axle insertion opening 40 leads to a transversely oriented axle attachment chamber 42 that is sized and shaped to removably receive and securely rotatably retain the cam axle 54 of the camming lever 20 therein in a snap-fit relationship allowing the camming lever to rotate when a rotational force is applied to the camming lever by a user. The lower portion 22L of the sealing member 22 may have an upward facing surface portion 44 extending about the upper portion 22U which supports an elastically deformable gasket 45 that forms a fluid-tight seal with the lid lower surface 35 of the lower portion 16 of the lid main body 12 which extends around the perimeter of the drinking aperture 18 when the sealing member is in the sealed position.

Figure 4A:
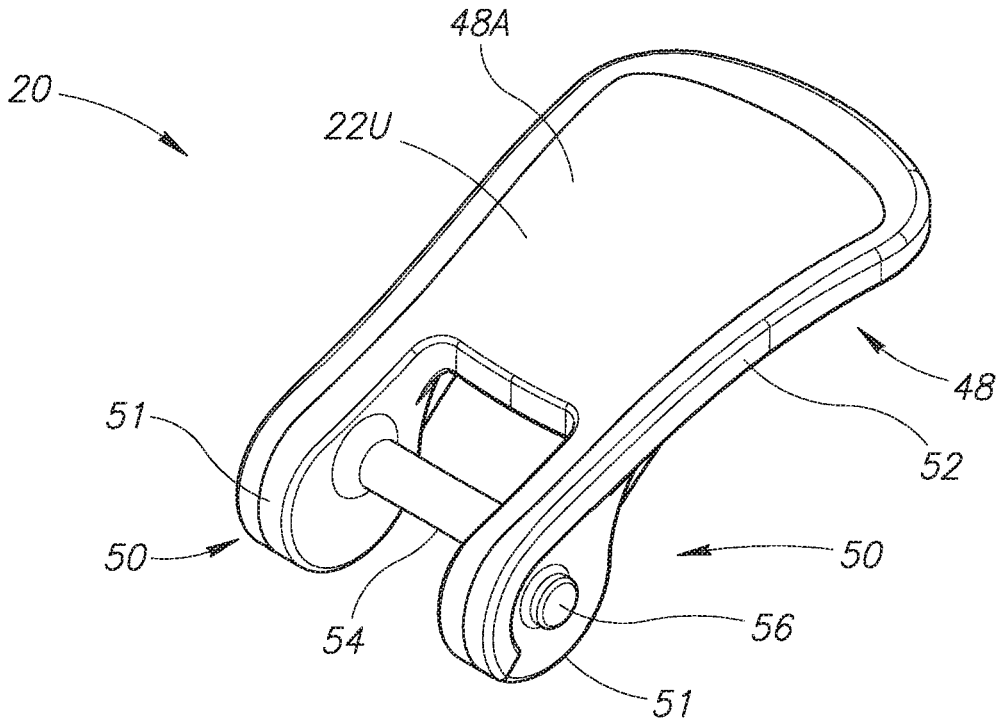
FIG. 4A illustrates a top perspective view of a camming lever of the lid assembly of FIG. 1A.
Figure 4B:
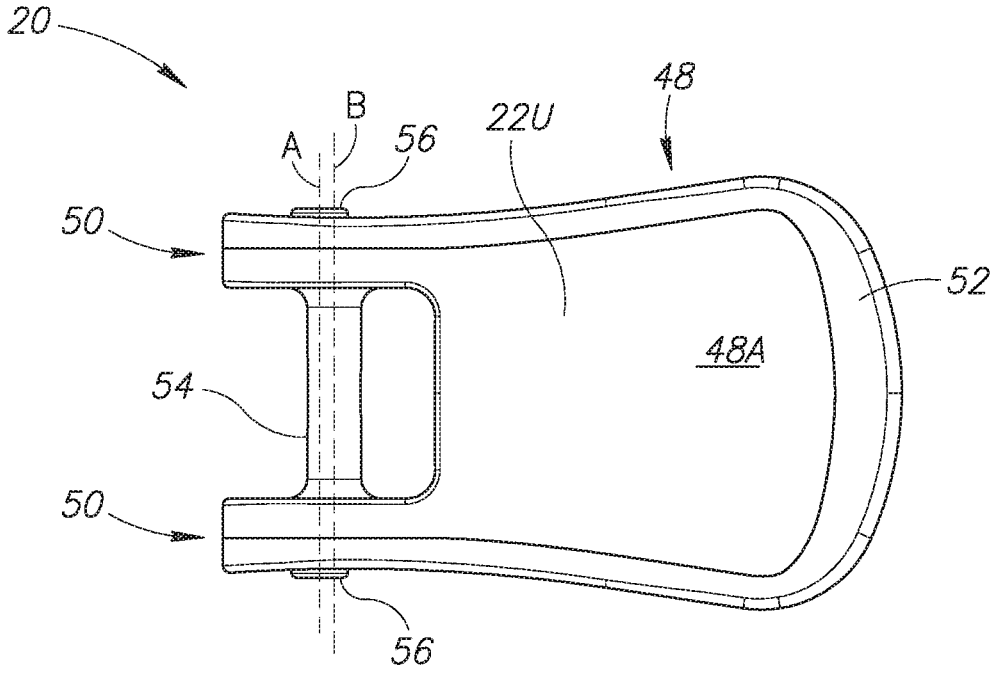
FIG. 4B illustrates a top plan view of the camming lever of FIG. 4A.
Figure 4C:
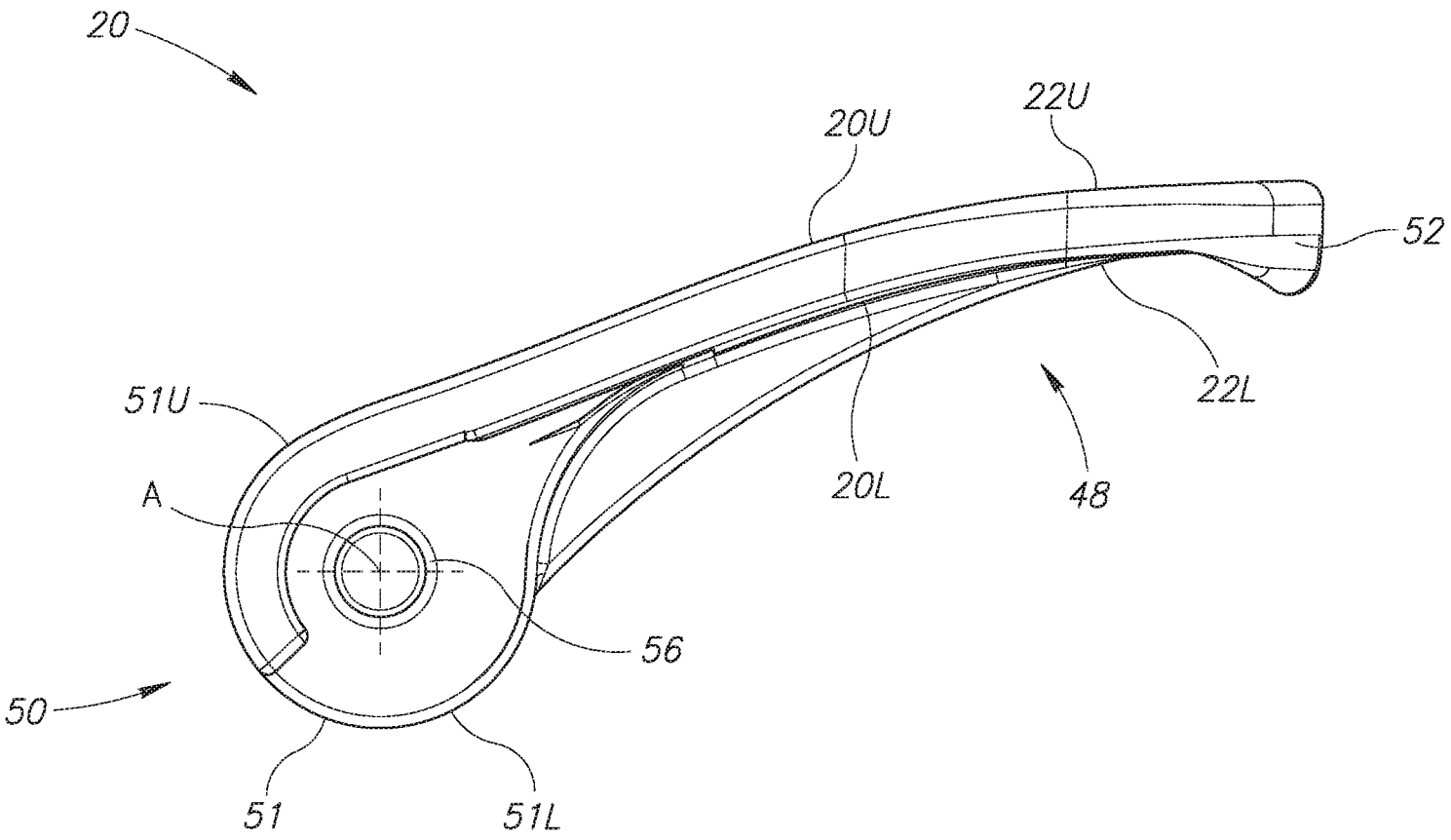
FIG. 4C illustrates a side view of the camming lever of FIG. 4A.
Figure 7A:
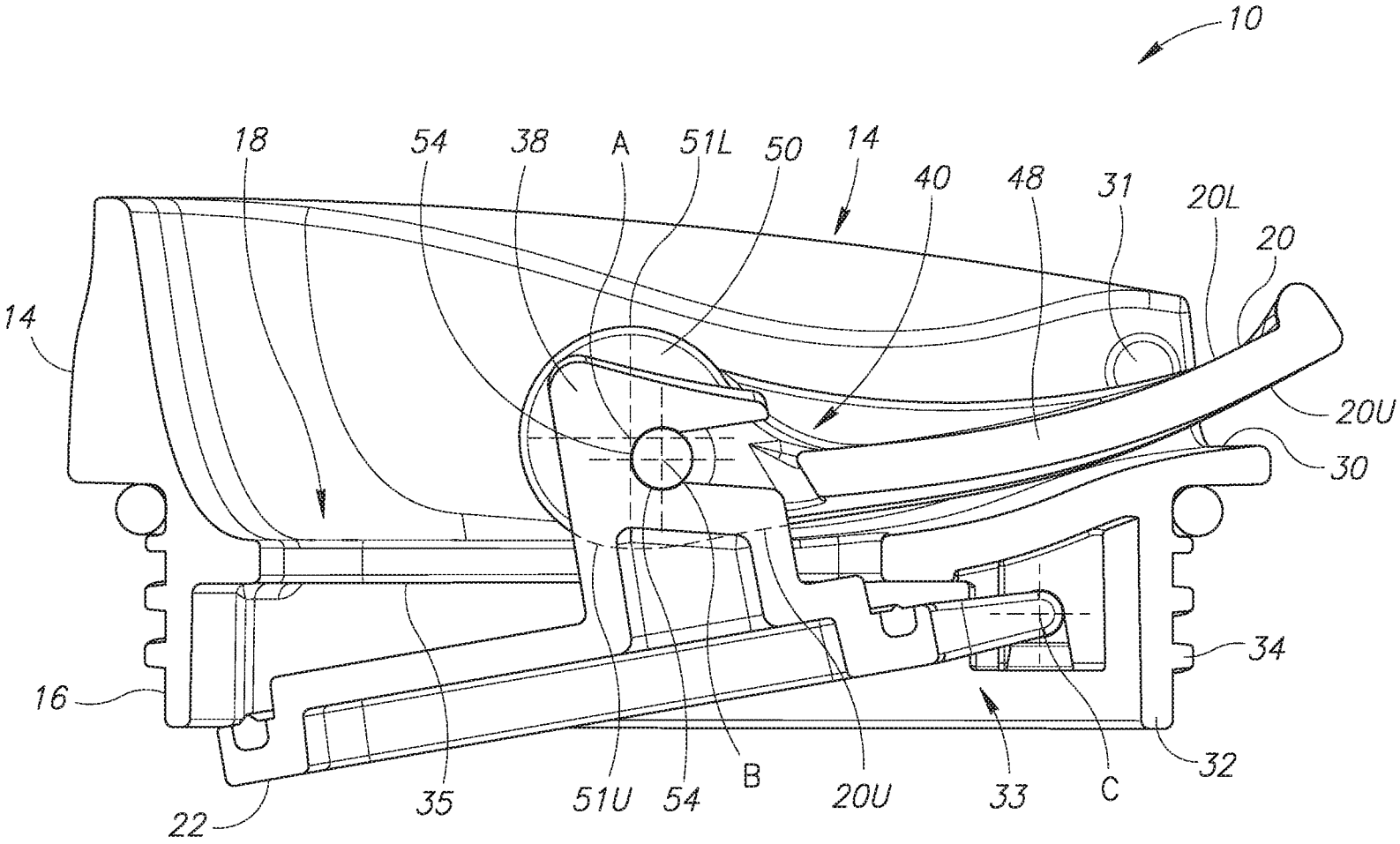
FIG. 7A illustrates a first cross-sectional side view taken substantially along the line A1-A1 of FIG. 1B of the lid assembly of FIG. 1A in the unsealed configuration.
Figure 7B:
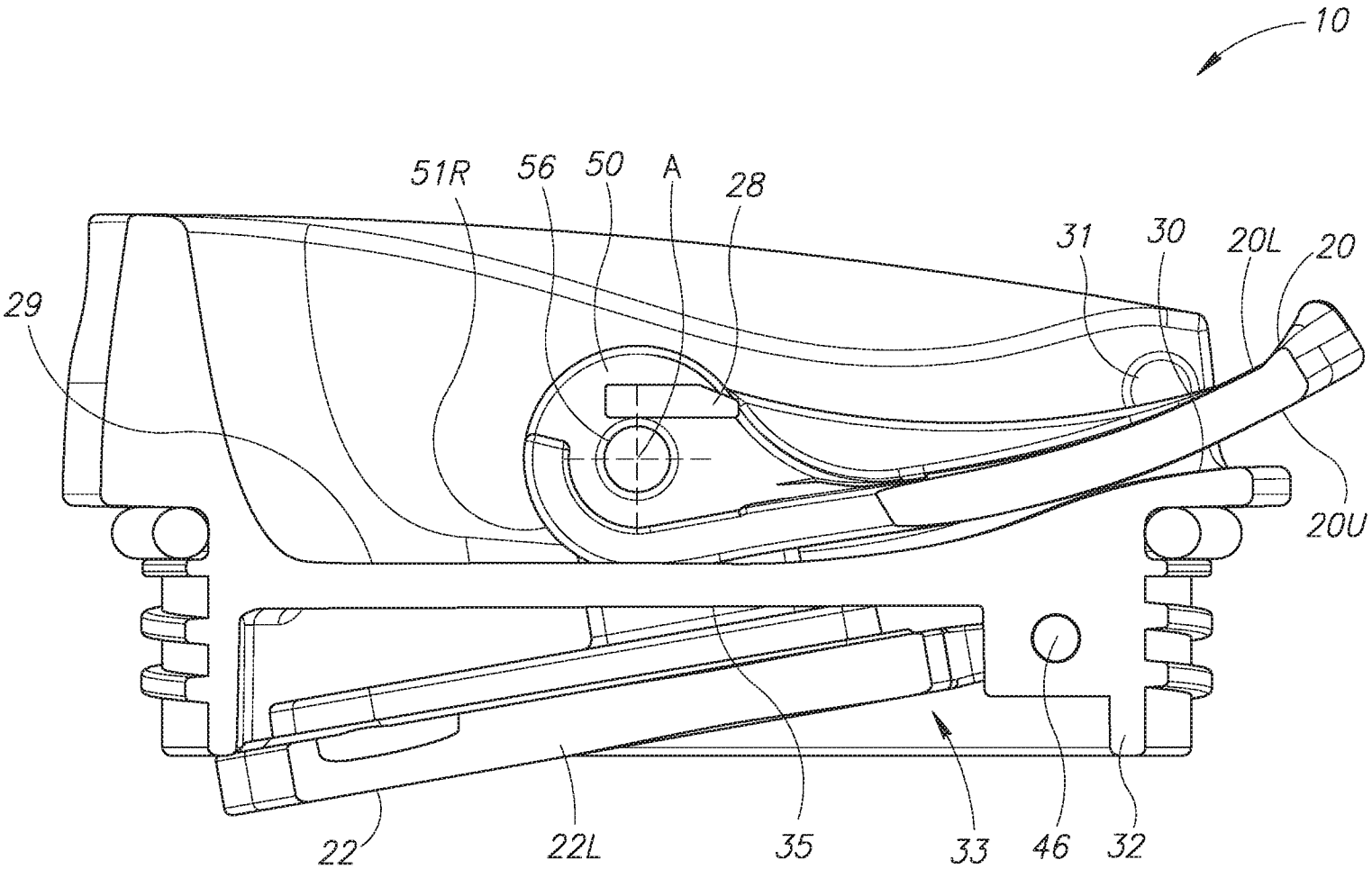
FIG. 7B illustrates a second cross-sectional side view taken substantially along the line A2-A2 of FIG. 1B of the lid assembly of FIG. 1A in the unsealed configuration.

The camming lever 20 has two generally circular cam lobes 50 disposed on an end of a lever arm 48, as shown in FIGS. 4A-4C. In the present embodiment, the lever arm 48 has a curved shape along its length. In some embodiments, the lever arm 48 may instead have a straight shape. The cam lobes 50 each have a rounded cam engagement surface 51 on an outer peripheral edge of the cam lobe 50. Each cam engagement surface 51 has an interface upper portion 51U and an interface lower portion 51L, as shown in FIG. 4C. In the present embodiment, the lever arm 48 has a wide body portion 48A that extends over and shields the drinking aperture 18 when the sealing member 22 is in the sealed position with the drinking aperture closed, as shown in FIG. 6A, serving as a cover for the drinking aperture. The detents 31 of the lid main body 12 may contact the sides of the wide body portion of the lever arm 48 to help retain the camming lever 20 in place when in the unsealed position with the drinking aperture 18 open, as shown in FIGS. 7A and 7B. In some embodiments, the lever arm 48 may have a different shape, such as a narrow shaft or shafts projecting from the cam lobes 50. A soft over-mold 52 may be provided around all or part of a peripheral edge of the lever arm 48 to help prevent abrasion between the lever arm and the lid main body 12.

The cam axle 54 is cylindrical in cross-section and extends between and connects together the inwardly facing sides of the cam lobes 50. A stub axle 56 (stop member portion) projects from the outwardly facing side of each of the cam lobes 50. The stub axels 56 are both located on a center axis A as shown in FIGS. 4C, 6A and 6B. The cam axle 54 is located on a center axis B about which the camming lever 20 rotates relative the sealing member 22. Axis A of the stub axles 56 is substantially parallel to but offset from the axis B of the cam axle 54 and the sealing member 22. Axis B is coaxial with the axis of the axis attachment chamber 42 of the sealing member 22. When the cam lever 20 is moved to the first position as shown in FIG. 6A, the axis B of the cam axle 54 is forward of and above axis A of the stub axles 56 (shown schematically in FIG. 9C). When the cam lever 20 is moved to the second position as shown in FIG. 7A, the axis B of the cam axle 54 is rearward of and below axis A of the stub axles 56 (shown schematically in FIG. 9A). Throughout the movement of the cam lever 20 between the first and second positions of the cam lever, the stub axles 56 are in one or both of sliding and rolling engagement with the lower sides or surfaces of the ledges 28 which limit upward movement of the stub axles, hence the axis A of the stub axles remains at substantially the same distance above the lid upper surface 29 while rotation of the cam lever 20 causes raising and lowering as well as forward and rearward movement of the axis B of the cam axle 54 which produces raising and lowering of the sealing member 22 to which the cam axle is rotatably attached. As the cam lever 20 is rotated the stub axles 56 are free to slide and roll forward and rearward along the lower surfaces of the ledges 28.

Figure 5:
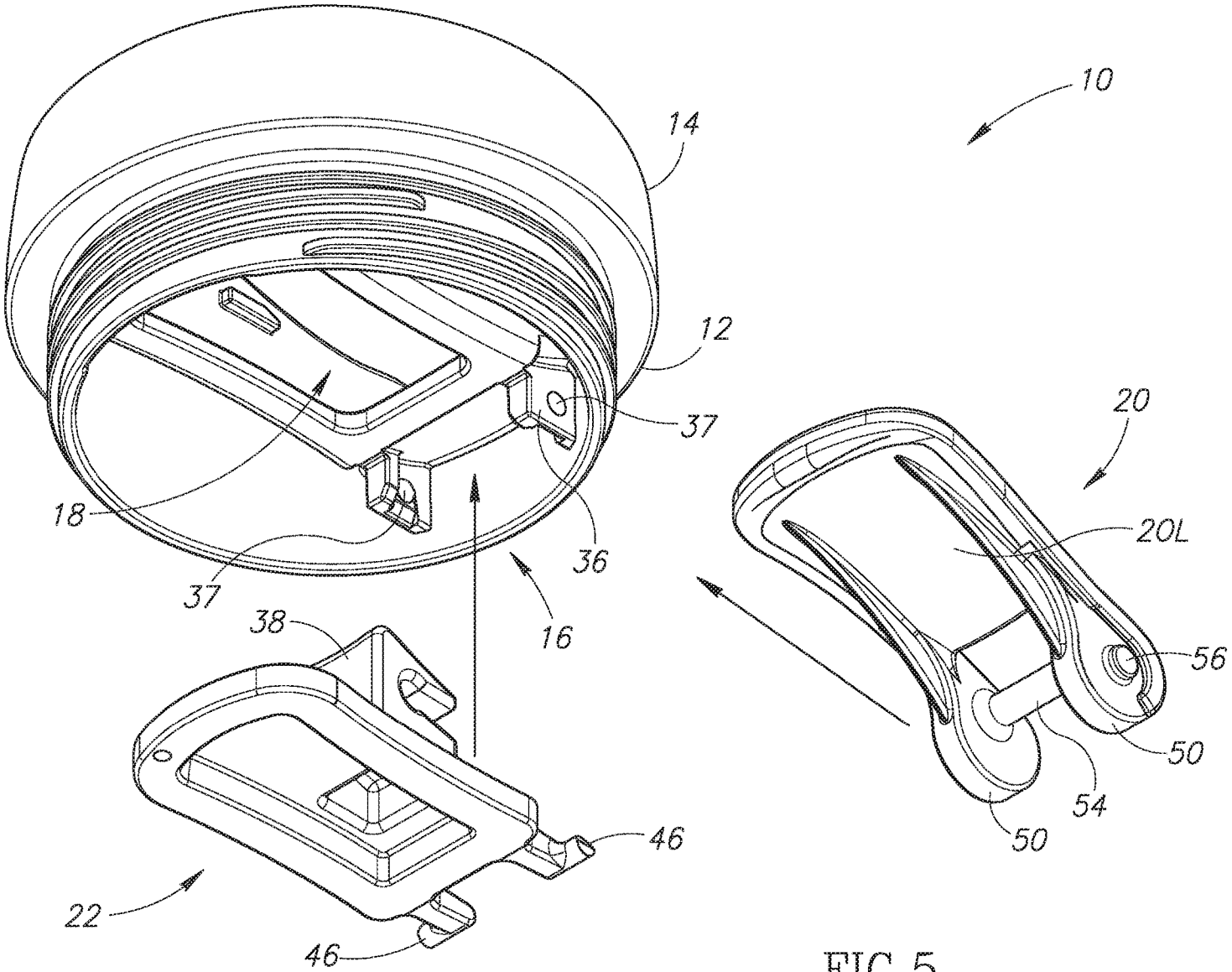
FIG. 5 illustrates an exploded view of the lid assembly of FIG. 1A.

Assembly of the lid assembly 10 is described with reference to FIG. 5. First, with the axle attachment element 38 oriented toward the drinking aperture 18, the arms 23 of the lower portion 22L of the sealing member 22 are flexed inwardly and then positioned between the sealing member attachment portions 36 on the lower portion 16 of the lid main body 12 so as to position the free ends of each of the pivot pins 46 for entry into one the corresponding aperture 37 of the sealing member attachment portions 36. The arms 23 are resilient and when released they move outward and insert the pivot pins 46 within the apertures 37 for rotatable attachment of the sealing member 22 to the lid main body 12 for rotation of the sealing member relative to the lid main body about an axis C, shown in FIGS. 6A and 7A, centered on the apertures 37 of the sealing member attachment portions 36. In such manner, the sealing member 22 is movable relative to the lid main body 12 along a circular arcuate rotational path centered on the axis C as the sealing member is rotated between the sealed and unsealed positions by rotation of the camming lever 20 between its first and second positions, respectively.

Second, the sealing member 22 is rotated to position the upper portion 22U of the sealing member 22 within the drinking aperture 18 such that the axle attachment element 38 extends upward through the drinking aperture and into the elongated recess 24 of the lid main body 12.

Third, the cam axle 54 of the camming lever 20 is inserted into the mouth of the axle insertion opening 40 of the sealing member 22 and snap-fitted into the axle attachment chamber 42 with the stub axles 56 positioned below the corresponding ones of the ledges 28 projection inward from the sidewalls 26 of the elongated recess 24. The ledges 28 are sized to act as stops engaged by the stub axles 56 to limit upward movement of the camming lever 20 when rotated between its first and second positions. However, the stub axles 56 are free to slide and roll along the lower surfaces of the ledges 28. The camming lever 20 is retained by the lid assembly 10 via its attachment to the sealing member 22 rather than being directly attached to the lid main body 12. The cam axle 54 may freely rotate within the axle attachment chamber 42 relative to the lid main body 12. The lid assembly 10 being fully assembled, the camming lever 20 may be rotated back and forth between its first and second positions (i.e., between the detents 31 and the drinking lip 25) to selectively transition the lid assembly between a sealed configuration and an unsealed configuration, as described below.

When the lid assembly 10 is in the sealed configuration, the sealing member 22 is in the sealed position sealing the drinking aperture 18 of the lid main body 12, as shown in FIG. 6A (cross-sectional view along line A1-A1). The lever arm 48 of the camming lever 20 is positioned toward the drinking lip 25 of the lid main body 12 and extends above and covers the drinking aperture 18 shielding the drink aperture and the portion of the sealing member 22 sealing the drink aperture. The lower surface 20L of the camming lever 20 faces downward toward the lid upper surface 29. The interface lower portion 51L of the cam engagement surface 51 of each cam lobe 50 contacts the portion of the lid upper surface 29 therebelow, as shown in FIG. 6B (cross-sectional view along line A2-A2). The stub axles 56 of the cam lobes 50 each contact a lower surface of one of the ledges 28 thereabove. When in the sealing position the cam lobes 50 are in sliding engagement with the lid upper surface 29 simultaneous with the stub axles 56 being in sliding engagement with the lower surface of the ledges 28. When the camming lever 20 is in this position, the camming lever is in its first position and the cam axle 54 is centered along axis B at a position sufficiently above the interface lower portion 51L and the lid upper surface 29 that the sealing member 22 through its rotatable attachment to the cam axle is held with the lower portion 22L thereof sealing the drinking aperture 18. That is, the axis B along which cam axle 54 is centered is offset forward and above the axis A of the cam lobes 50. The cam axle 54 positions the axle attachment element 38 in a raised position above the lid upper surface 29 holding the sealing member upper portion 22U in a close-fit within the drinking aperture 18. The sealing member lower portion 22L is tightly pressed against the lid lower surface 35 to form a fluid-tight seal, helping to retain heat and liquid within the drinking vessel 80 when the lid assembly 10 is attached thereto. Equipping the sealing member 20 with the elastically deformable gasket 45 on the upward facing surface portion of the lower portion 22L of the sealing member further aids in creating the fluid-tight seal.

When the lid assembly 10 is in the unsealed configuration, the sealing member 22 is in the unsealed position spaced apart from and below the lid lower surface 35 of the lower portion 16 of the lid main body 12, thus opening the drinking aperture 18, as shown in FIG. 7A (cross-sectional view along line B1-B1) and FIG. 7B (cross-sectional view along line B2-B2). The lever arm 48 of the camming lever 20 is positioned toward the elevated portion 30 at the rearward end of the elongated recess 24 of the lid main body 12. When the lever arm 48 of the camming lever 20 is in this position, the detents 31 help to retain the camming lever in its second position with the sealing member 22 in the unsealed position. The upper surface 20U of the camming lever 20 faces the elevated portion 30 of the lid main body 12. The interface upper portion 51U of each cam lobe 50 is in sliding engagement with or positioned slightly above the lid upper surface 29. The stub axles 56 of the cam lobes 50 each contact the lower surface of one of the ledges 28 thereabove and are in sliding engagement therewith. The cam axle 54 is centered along axis along axis B at a position sufficiently close to the lid upper surface 29 that the sealing member 22 through its rotatable attachment to the cam axle is held low enough that the lower portion 22L thereof is spaced away from and below the drinking aperture 18 allowing liquid from the drinking vessel 80 to flow through the drinking aperture when the lid assembly 10 is attached thereto.

Figure 9A:
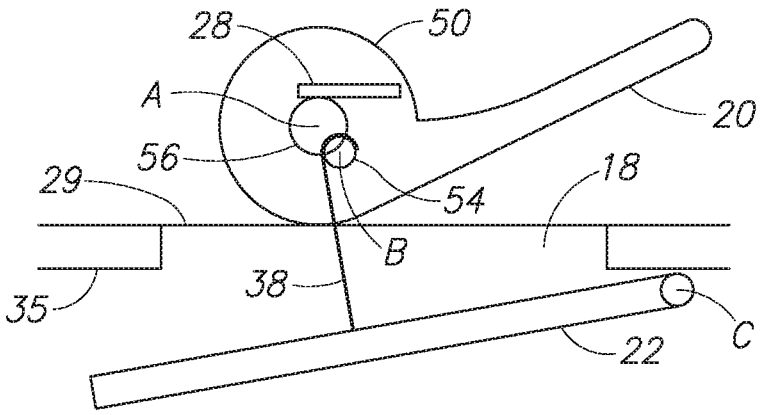
FIG. 9A is a schematic illustration of the lid assembly of FIG. 1A in the unsealed configuration.

The movement of the cam lever 20 back and forth between the first and second positions, and respectively, the resulting movement of the sealing member 22 back and forth between sealed and unsealed positions sealing and unsealing the drinking aperture 18, as described above, are shown schematically if FIGS. 9A-9C. In FIG. 9A the lid assembly is shown schematically with the cam lever 20 in the second position with the sealing member 22 in the unsealed position and the drinking aperture 18 open allowing liquid from the drinking vessel 80 to flow through the drinking aperture when the lid assembly 10 is attached thereto. In the second position of the cam lever 20 the axis B of the cam axle 54 is rearward of and below axis A of the stub axles 56 (see FIGS. 7A and 9A), as viewed from the side of the lid assembly 10.

Rotation of the cam lever 20 in the counterclockwise direction from the second position toward the first position (movement from the position in FIG. 9A toward the mid-position in FIG. 9B) causes the stub axles 56 to rotate counterclockwise and roll rearward along the lower surfaces of the ledges 28. At the same time this movement causes the axis B of the of the cam axle 54 to move upward and lift the sealing member 22 upward by applying a lifting force thereon through the axle attachment element 38 (shown schematically as a straight line in FIGS. 9A-9C) of the sealing member to move the sealing member upper portion 22U upward toward engagement with the lid lower surface 35 surrounding the drinking aperture 18.

Figure 9B:
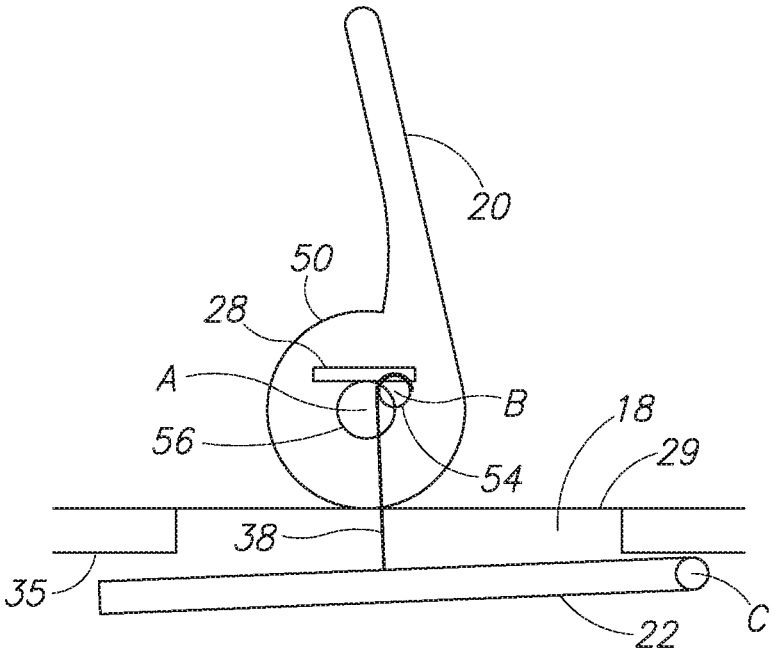
FIG. 9B is a schematic illustration of the lid assembly of FIG. 1A in a mid-position between the unsealed configuration of FIG. 9A and the sealed configuration of FIG. 9C.
Figure 9C:
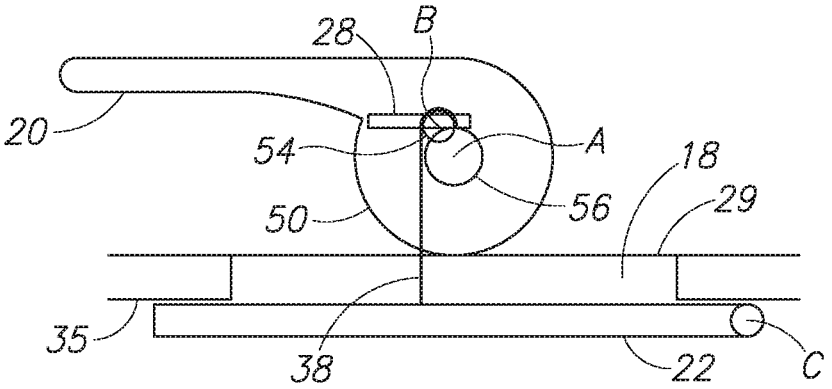
FIG. 9C is a schematic illustration of the lid assembly of FIG. 1A in the sealed configuration.

Further counterclockwise rotation of the cam lever 20 from the mid-position shown in FIG. 9B to the first position shown in FIG. 9C causes the stub axles 56 to continue rotating counterclockwise and roll further rearward along the lower surfaces of the ledges 28. At the same time this movement causes further upward movement of the axis B of the of the cam axle 54 to move upward and lift the sealing member 22 upward by applying a lifting force thereon through the axle attachment element 38 of the sealing member to move the sealing member upper portion 22U into sealing engagement with the lid lower surface 35 surrounding the drinking aperture 18. At the same time, the movement causes the axis B of the cam axle 54 to move forward and pass over the axis A of the stub axles 56 providing a cam over center movement which, when the cam lever 20 is in the first position of FIG. 9C, tends to resist unintentional clockwise rotation of the cam lever center and hold the sealing member upper portion 22U in fluid-tight sealing engagement with the lid lower surface 35.

The motions described are reversed when the cam lever 20 is moved from the first position to the second position.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Accordingly, the invention is not limited except as by the appended claims.

What is claimed is:

1. A lid assembly for a drinking vessel, comprising:

a lid main body having a lid portion with a drinking aperture and a pair of spaced apart stop portions positioned above the drinking aperture;

a sealing member having a sealing portion and an axle attachment portion, the sealing portion being positioned below the drinking aperture and sized and shaped to selectively seal the drinking aperture, the sealing member being pivotally attached to the lid main body and rotatably movable between a sealed position with the sealing portion sealing the drinking aperture and an unsealed position with the sealing portion unsealing the drinking aperture, the axle attachment portion being attached to an upper side of the sealing portion and extending upward through the drinking aperture; and a camming lever having a cam arm attached to a pair of laterally spaced apart cams to rotate the cams in response to rotation of the cam arm, a laterally extending cam axle positioned between and attached to each of the cams, and a stub axle extending laterally outward from each of the cams, the cams being positioned to engage the lid portion and the stub axles each being positioned to engage a corresponding one of the stop portions of the lid main body to limit upward movement of the stub axles while permitting at least limited forward and rearward movement of the stub axles, the cam axle being in detachable pivotal engagement with the axle attachment portion of the sealing member, the cam arm having a first rotational position whereat the cam axle is in a first position holding the sealing portion of the sealing member in the sealed position and a second rotational position whereat the cam axle is in a second position with the sealing portion of the sealing member in the unsealed position, when the cam axle is detached from the axle attachment portion, the sealing member is separated from the camming lever and rotatable downward relative to the lid main body independent of the rotational position of the cam arm.

2. The lid assembly of claim 1 wherein the axle attachment portion has an axle insertion opening leading to an axle attachment chamber, the axle insertion opening permitting the cam axle to move therethrough for positioning in the axle attachment chamber, the axle attachment chamber being sized and shaped to removably receive the cam axle therein in detachable pivotal engagement with the axle attachment portion, and when the cam axle is within the axle attachment chamber, the cam axle is rotatably retained therein as the cam arm is moved between the first and second rotational positions to move the sealing portion of the sealing member between the sealed position and the unsealed position.

3. The lid assembly of claim 1 wherein the stub axles have a common first axis and the cam axle has a second axis, with the first and second axes being out of coaxial alignment.

4. The lid assembly of claim 3 wherein when the cam arm is in the first rotational position the second axis of the cam axle is located above and forward of the first axis of the stub axles, and when the cam arm is in the second rotational position the second axis of the cam axle is located below and rearward of the first axis of the stub axles.

5. The lid assembly of claim 4 wherein the camming lever is configured such that as the cam arm is moved between the first and second rotational positions the second axis of the cam axle follows a path passing over the first axis of the stub axles.

6. The lid assembly of claim 3 wherein the sealing member is pivotally attached to the lid main body for rotation about a third axis out of coaxial alignment with both the first and second axes of the stub axles and the cam axle.

7. The lid assembly of claim 1 wherein the lid main body further includes a upwardly facing recess in fluid communication with the drinking aperture and having a drinking lip at a forward end of the recess projecting upward above the drinking aperture, the recess having first and second sidewalls positioned on opposite sides of the drinking aperture, one of the stop portions being attached to and projecting laterally inward from the first sidewall and the other of the stop portions being attached to and projecting laterally inward from the second sidewall.

8. The lid assembly of claim 7 wherein the cam arm when in the first rotational position extends over the drinking aperture, thereby shielding the drinking aperture.

9. The lid assembly of claim 1 wherein the cams comprise first and second cams, each have a rounded cam peripheral edge wall portion which engages the lid portion, one of the stub axles being attached to the first cam at a central location of the first cam and the other of the stub axles being attached to the second cam at a location a central location of the second cam, the cam axle having first and second ends, the first end of the cam axle being attached to the first cam at a location offset from the central location of the first cam and the second end of the cam axle being attached to the second cam at a location offset from the central location of the second cam.

10. A lid assembly for a drinking vessel, comprising:

a lid main body having a left and right lid portions with a drinking aperture located therebetween and spaced apart left and right stop portions positioned above the drinking aperture, the left stop portion being located to the left of the drinking aperture and the right stop portion being located to the right of the drinking aperture;

a sealing member having a sealing portion and an axle attachment portion, the sealing portion being positioned below the drinking aperture and sized and shaped to selectively seal the drinking aperture, the sealing member being pivotally attached to the lid main body and rotatably movable between a sealed position with the sealing portion sealing the drinking aperture and an unsealed position with the sealing portion unsealing the drinking aperture, the axle attachment portion being attached to an upper side of the sealing portion and extending upward through the drinking aperture; and a camming lever having a cam arm attached to a pair of laterally spaced apart left and right cams to rotate the left and right cams in response to rotation of the cam arm, a laterally extending cam axle positioned between and attached to both of the left and right cams, a left stub axle extending laterally outward from the left cam and a right stub axle extending laterally outward from the right cam, the left cam being positioned to engage the left lid portion and the right cam being positioned to engage the right lid portion, the left stub axle being positioned to engage the left stop portion of the lid main body to limit upward movement of the left stub axle without limiting forward and rearward movement of the left stub axle and the right stub axle being positioned to engage the right stop portion of the lid main body to limit upward movement of the right stub axle while permitting at least limited forward and rearward movement of the right stub axle, the cam axle being in detachable pivotal engagement with the axle attachment portion of the sealing member, the cam arm having a first rotational position whereat the cam axle is in a first position holding the sealing portion of the sealing member in the sealed position and a second rotational position whereat the cam axle is in a second position with the sealing portion of the sealing member in the unsealed position, when the cam axle is detached from the axle attachment portion, the sealing member is separated from the camming lever and rotatable relative to the lid main body independent of the rotational position of the cam arm.

11. The lid assembly of claim 10 wherein the axle attachment portion has an axle insertion opening leading to an axle attachment chamber, the axle insertion opening permitting the cam axle to move therethrough for positioning in the axle attachment chamber, the axle attachment chamber being sized and shaped to removably receive the cam axle therein in detachable pivotal engagement with the axle attachment portion, and when the cam axle is within the axle attachment chamber, the cam axle is rotatably retained therein as the cam arm is moved between the first and second rotational positions to move the sealing portion of the sealing member between the sealed position and the unsealed position.

12. The lid assembly of claim 10 wherein the left and right stub axles have a common first axis and the cam axle has a second axis, with the first and second axes being out of coaxial alignment.

13. The lid assembly of claim 12 wherein when the cam arm is in the first rotational position the second axis of the cam axle is located above and forward of the first axis of the stub axles, and when the cam arm is in the second rotational position the second axis of the cam axle is located below and rearward of the first axis of the stub axles.

14. The lid assembly of claim 13 wherein the camming lever is configured such that as the cam arm is moved between the first and second rotational positions the second axis of the cam axle follows a path passing over the first axis of the stub axles.

15. The lid assembly of claim 12 wherein the sealing member is pivotally attached to the lid main body for rotation about a third axis out of coaxial alignment with both the first and second axes of the stub axles and the cam axle.

16. The lid assembly of claim 12 wherein the lid main body further includes a upwardly facing recess in fluid communication with the drinking aperture and having a drinking lip at a forward end of the recess projecting upward above the drinking aperture, the recess having left and right sidewalls positioned on opposite sides of the drinking aperture, the left stop portion being attached to and projecting laterally inward from the left sidewall and the right stop portion being attached to and projecting laterally inward from the right sidewall.

17. The lid assembly of claim 16 wherein the cam arm when in the first rotational position extends over the drinking aperture, thereby shielding the drinking aperture.

18. The lid assembly of claim 10 wherein the left cam has a rounded cam peripheral edge wall portion which engages the left lid portion, the right cam has a rounded cam peripheral edge wall portion which engages the right lid portion, the left stub axle being attached to the left cam at a central location of the left cam, the right stub axle being attached to the right cam at a central location of the right cam, the cam axle having left and right ends, the left end of the cam axle being attached to the left cam at a location offset from the central location of the left cam and the right end of the cam axle being attached to the right cam at a location offset from the central location of the right cam.

19. A lid assembly for a drinking vessel, comprising:

a lid main body having a lid portion with a drinking aperture and a stop portion;

a sealing member having a sealing portion sized and shaped to selectively seal the drinking aperture, the sealing member being pivotally attached to the lid main body and rotatably movable between a sealed position with the sealing portion sealing the drinking aperture and an unsealed position with the sealing portion unsealing the drinking aperture;

a camming lever having a cam arm attached to a cam to rotate the cam in response to rotation of the cam arm, a laterally extending cam axle attached to the cam and a stub axle extending laterally outward from the cam, the cam being positioned to engage the lid portion and the stub axle being positioned to engage the stop portion of the lid main body to limit upward movement of the stub axle while permitting at least limited forward and rearward movement of the stub axle; and a connector member extending between and connected to the sealing member and the cam axle, wherein the cam arm has a first rotational position whereat the cam axle is in a first position holding the sealing portion of the sealing member in the sealed position and a second rotational position whereat the cam axle is in a second position with the sealing portion of the sealing member in the unsealed position.

20. The lid assembly of claim 19 wherein the sealing portion is positioned below the drinking aperture and the connector member extends upward from the sealing portion through the drinking aperture.

21. The lid assembly of claim 19 wherein the connector member is pivotally connected to the cam axle.

22. The lid assembly of claim 21 wherein the connector member is rigidly connected to the sealing member.

23. The lid assembly of claim 19 wherein the cam axle is in detachable pivotal engagement with the connector member, and when the cam axle is detached from the connector member, the sealing member is separated from the camming lever and rotatable downward relative to the lid main body independent of the rotational position of the cam arm.

24. The lid assembly of claim 23 wherein the connector member has an axle insertion opening leading to an axle attachment chamber, the axle insertion opening permitting the cam axle to move therethrough for positioning in the axle attachment chamber, the axle attachment chamber being sized and shaped to removably receive the cam axle therein in detachable pivotal engagement with the connector member, and when the cam axle is within the axle attachment chamber, the cam axle is rotatably retained therein as the cam arm is moved between the first and second rotational positions to move the sealing portion of the sealing member between the sealed position and the unsealed position.

25. A lid assembly for a drinking vessel, comprising:

a lid main body having a lid portion with a drinking aperture;

a sealing member having a sealing portion sized and shaped to selectively seal the drinking aperture, the sealing member being pivotally attached to the lid main body and rotatably movable between a sealed position with the sealing portion sealing the drinking aperture and an unsealed position with the sealing portion unsealing the drinking aperture;

an actuator;

a connector member extending between and connected to the sealing member and the actuator, wherein the actuator has a first rotational position whereat the sealing portion of the sealing member is in the sealed position and a second rotational position whereat the sealing portion of the sealing member is in the unsealed position; and wherein the sealing portion is positioned below the drinking aperture and the connector member extends upward from the sealing portion through the drinking aperture, the actuator being connected to the connector member at a location above the drinking aperture, wherein the actuator is rotatable between the actuator first and second rotational positions, and the actuator includes a cam in engagement with an upper side of the lid portion adjacent the drinking aperture, the cam rotating with rotation of the actuator between the first and second positions of the actuator, rotation of the actuator to the first rotational position causing the cam to rotate and thereby move the actuator to apply an upward force through the connector member to the sealing member to move the sealing portion of the seal member upward into the sealed position, and rotation of the actuator to the second rotational position causing the cam to rotate and thereby move the actuator to apply a downward force through the connector member to the sealing member to move the sealing portion of the sealing member downward into the unsealed position, and wherein the lid portion has a stop portion positioned above the drinking aperture, and the cam has a stub axle extending laterally from the cam, the stub axle being positioned to engage the stop portion of the lid main body to limit upward movement of the stub axle while permitting at least limited forward and rearward movement of the stub axle.

26. The lid assembly of claim 25 wherein the actuator is pivotally connected to the connector member.

27. The lid assembly of claim 26 wherein the connector member is rigidly connected to the sealing member.

28. The lid assembly of claim 25 wherein the actuator is in detachable pivotal engagement with the connector member, and when the actuator is detached from the connector member, the sealing member is separated from the actuator and rotatable downward relative to the lid main body independent of the rotational position of the actuator.

29. The lid assembly of claim 28 wherein the cam has a cam axle extending laterally from the cam, and the connector member has an axle insertion opening leading to an axle attachment chamber, the axle insertion opening permitting the cam axle to move therethrough for positioning in the axle attachment chamber, the axle attachment chamber being sized and shaped to removably receive the cam axle therein in detachable pivotal engagement with the connector member, and when the cam axle is within the axle attachment chamber, the cam axle is rotatably retained therein as the actuator is moved between the first and second rotational positions to move the sealing portion of the sealing member between the sealed position and the unsealed position.

30. The lid assembly of claim 25 wherein the actuator has an actuator axle and the connector member has an axle insertion opening leading to an axle attachment chamber, the axle insertion opening permitting the actuator axle to move therethrough for positioning in the axle attachment chamber, the axle attachment chamber being sized and shaped to removably receive the actuator axle therein in detachable pivotal engagement with the connector member, and when the actuator axle is within the axle attachment chamber, the actuator axle is rotatably retained therein as the actuator is moved between the first and second rotational positions to move the sealing portion of the sealing member between the sealed position and the unsealed position.

* * * * *